US006138978A

United States Patent [19]

Andersen

[11] Patent Number: 6,138,978

[45] Date of Patent: Oct. 31, 2000

[54] FLAG POLE MOUNTING BASE

[76] Inventor: Niel K. Andersen, 40 Westover Gulch P.O. Box #248, Jefferson City, Mont. 59638

[21] Appl. No.: 09/329,176

[22] Filed: Jun. 10, 1999

[51] Int. Cl.[7] ..... A01K 97/10

[52] U.S. Cl. ..... 248/534; 248/538; 116/173; 52/295

[58] Field of Search ..... 248/514, 519, 248/520, 521, 534, 535, 539, 346.03, 346.06, 538; 52/295; 116/173

[56] References Cited

U.S. PATENT DOCUMENTS

| | | | |
|---|---|---|---|
| 1,482,036 | 1/1924 | Schablow | 116/173 |
| 3,311,333 | 3/1967 | Galloway | 52/295 |
| 3,792,680 | 2/1974 | Allen | 116/173 |
| 4,079,559 | 3/1978 | Tenbrummeler | 52/295 |
| 5,167,093 | 12/1992 | Hamilton | 49/35 |
| 5,520,479 | 5/1996 | Hernandez | 404/6 |
| 5,895,169 | 4/1999 | Holm et al. | 404/9 |

*Primary Examiner*—Ramon O. Ramirez
*Assistant Examiner*—Walter Landry

[57] ABSTRACT

A flag pole mounting base for mounting a flag pole thereto to permit pivoting of the flag pole between raised and lower positions. The flag pole mounting base includes a mounting base having a top face, an open bottom face, a spaced apart pair of end faces, and a spaced apart pair of side faces. The mounting base is designed for pivotally mounting to resting surface. The mounting base has a threaded bore therein with an opening in the top face of the mounting base. The threaded bore is designed for receiving a bottom end of a flag pole therein.

11 Claims, 3 Drawing Sheets

24
26
22
12
15
10
3
11
14
13
38
40
39
28
29
32
28
30
30
16
3
31
33

FLAG POLE MOUNTING BASE

BACKGROUND OF THE INVENTION

1. Field of the Invention

The present invention relates to flag pole mounting bases and more particularly pertains to a new flag pole mounting base for mounting a flag pole thereto to permit pivoting of the flag pole between raised and lower positions.

2. Description of the Prior Art

The use of flag pole mounting bases is known in the prior art. More specifically, flag pole mounting bases heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,095,788; U.S. Pat. No. 951,649; U.S. Pat. No. 5,365,694; U.S. Pat. No. 5,026,213; U.S. Pat. No. 5,040,924; and U.S. Pat. No. 4,939,877.

While these devices fulfill their respective, particular objectives and requirements, the aforementioned patents do not disclose a new flag pole mounting base. The inventive device includes a mounting base having a top face, an open bottom face, a spaced apart pair of end faces, and a spaced apart pair of side faces. The mounting base is designed for pivotally mounting to resting surface. The mounting base has a threaded bore therein with an opening in the top face of the mounting base. The threaded bore is designed for receiving a bottom end of a flag pole therein.

In these respects, the flag pole mounting base according to the present invention substantially departs from the conventional concepts and designs of the prior art, and in so doing provides an apparatus primarily developed for the purpose of mounting a flag pole thereto to permit pivoting of the flag pole between raised and lower positions.

SUMMARY OF THE INVENTION

In view of the foregoing disadvantages inherent in the known types of flag pole mounting bases now present in the prior art, the present invention provides a new flag pole mounting base construction wherein the same can be utilized for mounting a flag pole thereto to permit pivoting of the flag pole between raised and lower positions.

The general purpose of the present invention, which will be described subsequently in greater detail, is to provide a new flag pole mounting base apparatus and method which has many of the advantages of the flag pole mounting bases mentioned heretofore and many novel features that result in a new flag pole mounting base which is not anticipated, rendered obvious, suggested, or even implied by any of the prior art flag pole mounting bases, either alone or in any combination thereof.

To attain this, the present invention generally comprises a mounting base having a top face, an open bottom face, a spaced apart pair of end faces, and a spaced apart pair of side faces. The mounting base is designed for pivotally mounting to resting surface. The mounting base has a threaded bore therein with an opening in the top face of the mounting base. The threaded bore is designed for receiving a bottom end of a flag pole therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new flag pole mounting base apparatus and method which has many of the advantages of the flag pole mounting bases mentioned heretofore and many novel features that result in a new flag pole mounting base which is not anticipated, rendered obvious, suggested, or even implied by any of the prior art flag pole mounting bases, either alone or in any combination thereof.

It is another object of the present invention to provide a new flag pole mounting base which may be easily and efficiently manufactured and marketed.

It is a further object of the present invention to provide a new flag pole mounting base which is of a durable and reliable construction.

An even further object of the present invention is to provide a new flag pole mounting base which is susceptible of a low cost of manufacture with regard to both materials and labor, and which accordingly is then susceptible of low prices of sale to the consuming public, thereby making such flag pole mounting base economically available to the buying public.

Still yet another object of the present invention is to provide a new flag pole mounting base which provides in the apparatuses and methods of the prior art some of the advantages thereof, while simultaneously overcoming some of the disadvantages normally associated therewith.

Still another object of the present invention is to provide a new flag pole mounting base for mounting a flag pole thereto to permit pivoting of the flag pole between raised and lower positions.

Yet another object of the present invention is to provide a new flag pole mounting base which includes a mounting base having a top face, an open bottom face, a spaced apart pair of end faces, and a spaced apart pair of side faces. The mounting base is designed for pivotally mounting to resting surface. The mounting base has a threaded bore therein with an opening in the top face of the mounting base. The threaded bore is designed for receiving a bottom end of a flag pole therein.

Still yet another object of the present invention is to provide a new flag pole mounting base that lets a user pivot a flag pole to a horizontal lowered position so that the pole and a flag attached to a top end of the pole may be easily accessed by the user.

Even still another object of the present invention is to provide a new flag pole mounting base that is securable in an upright vertical position with padlocks.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
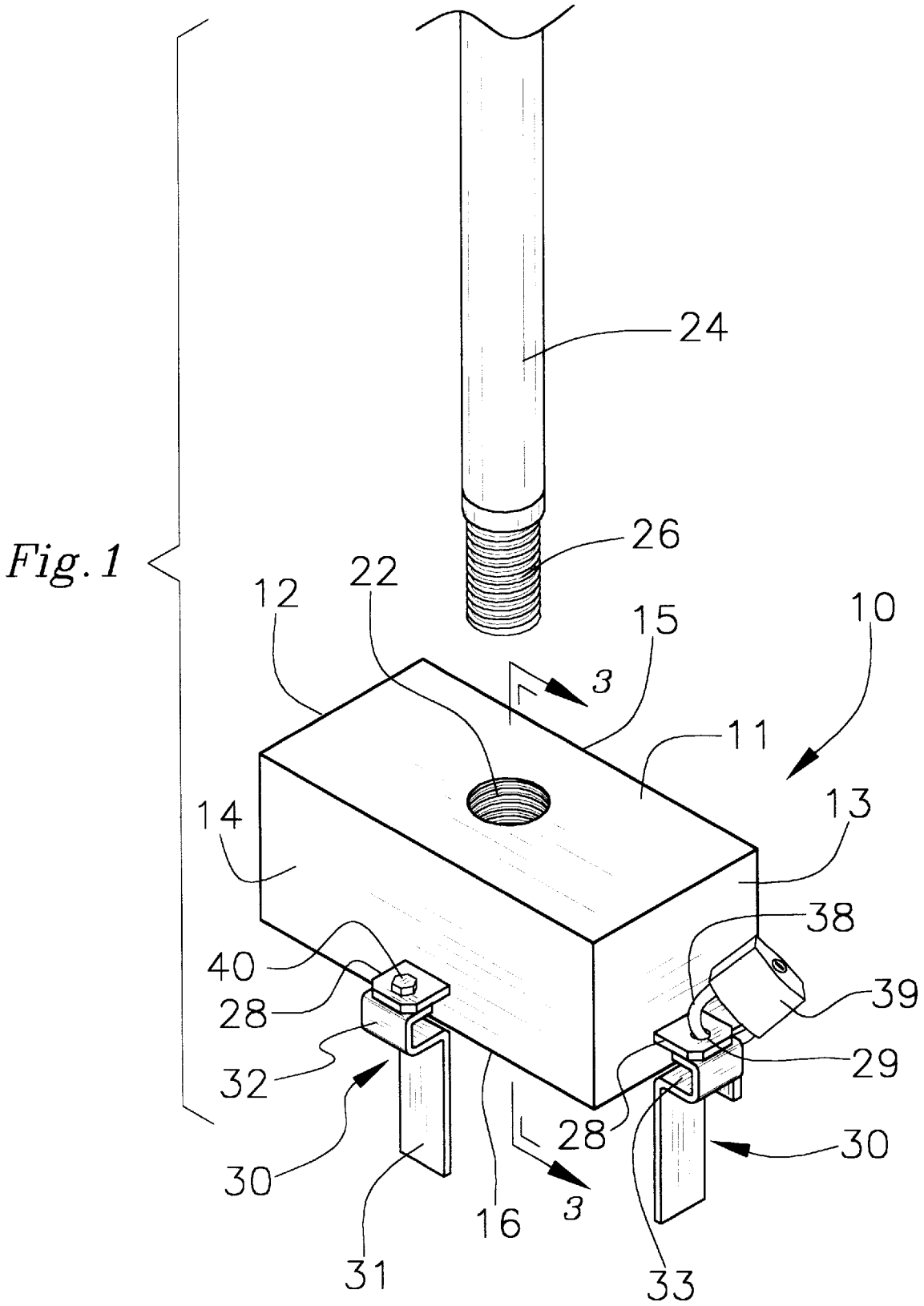
FIG. 1 is a schematic exploded perspective view of a flag pole mounting base according to the present invention.

With reference now to the drawings, and in particular to FIGS. 1 through 4 thereof, a new flag pole mounting base embodying the principles and concepts of the present invention will be described.

As best illustrated in FIGS. 1 through 4, the flag pole mounting base generally comprises a mounting base having a top face, an open bottom face, a spaced apart pair of end faces, and a spaced apart pair of side faces. The mounting base is designed for pivotally mounting to resting surface. The mounting base has a threaded bore therein with an opening in the top face of the mounting base. The threaded bore is designed for receiving a bottom end of a flag pole therein.

In closer detail, the mounting base provide a system for mounting a flag pole. Specifically, the mounting base 10 is preferably hollow and has a generally rectangular box-shaped configuration. The mounting base also includes a generally rectangular substantially planar top face 11, an open bottom face, a spaced apart pair of generally rectangular substantially planar end faces 12,13, and a spaced apart pair of generally rectangular substantially parallel side faces 14,15 extending substantially perpendicular to the end faces of the mounting base. The mounting base has a generally rectangular bottom edge 16 extending along the end and side faces to define the open bottom face of the mounting base. Preferably, the top face and the bottom edge of the mounting base lie in substantially parallel planes to one another.

A pair of hinges 17,18 are provided each having upper and lower leaves 19,20 pivotally coupled to each other. The upper leaves of the hinges are coupled to a first of the side faces of the mounting base ideally by a plurality of threaded fasteners and nuts. The lower leaves of the hinges are outwardly extended from the bottom edge of the mounting base.

A resting surface 21 preferably comprising a concrete material is provided on a ground surface. The lower leaves of the hinges are inserted into the resting surface so that the lower leaves are embedded in the concrete material. In use, the hinges permitting pivoting of the mounting base between raised and lowered positions with respect to the resting surface.

As best illustrated in FIG. 1, the bottom edge of the mounting base is rested on the resting surface such that the open bottom face faces the resting surface when the mounting base is positioned in the raised position. In the raised position, the top face of the mounting base faces upwards from the resting surface and lies in a substantially horizontal plane.

Figure 2:
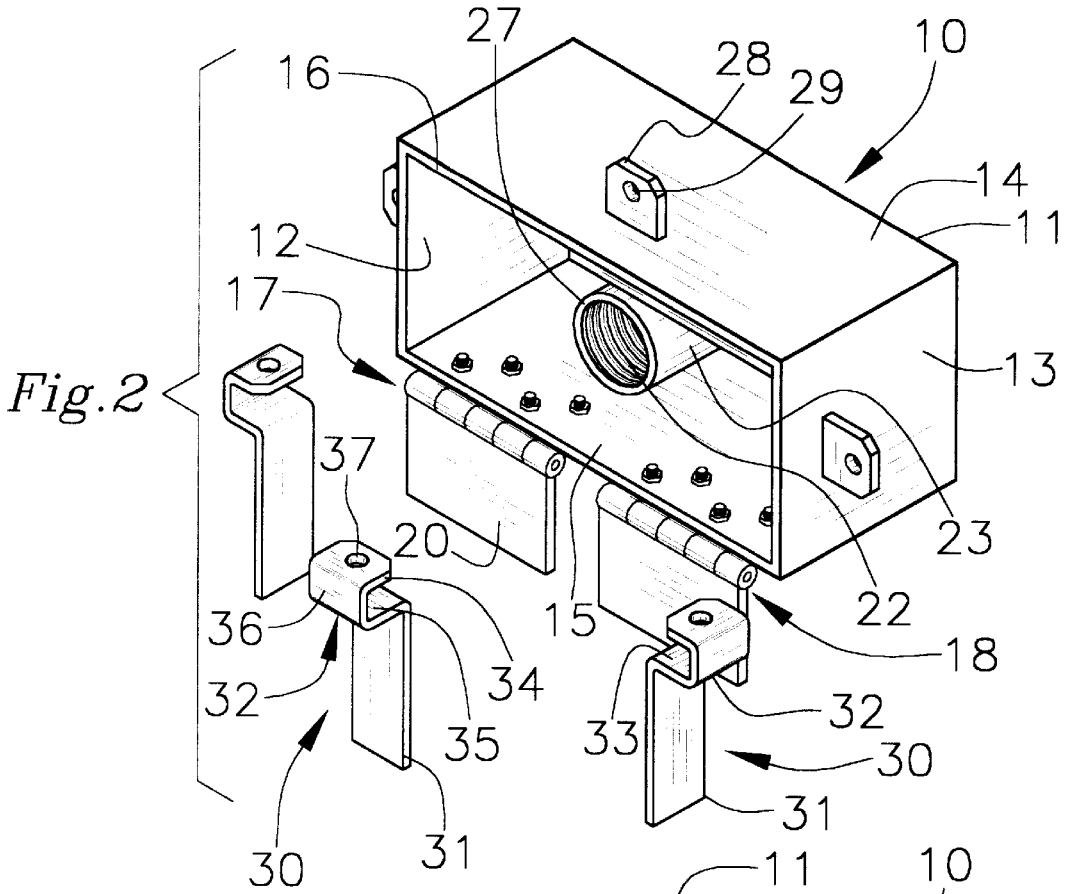
FIG. 2 is a schematic perspective view of the present invention in the lowered position with the open bottom face of the mounting base exposed.
Figure 4:
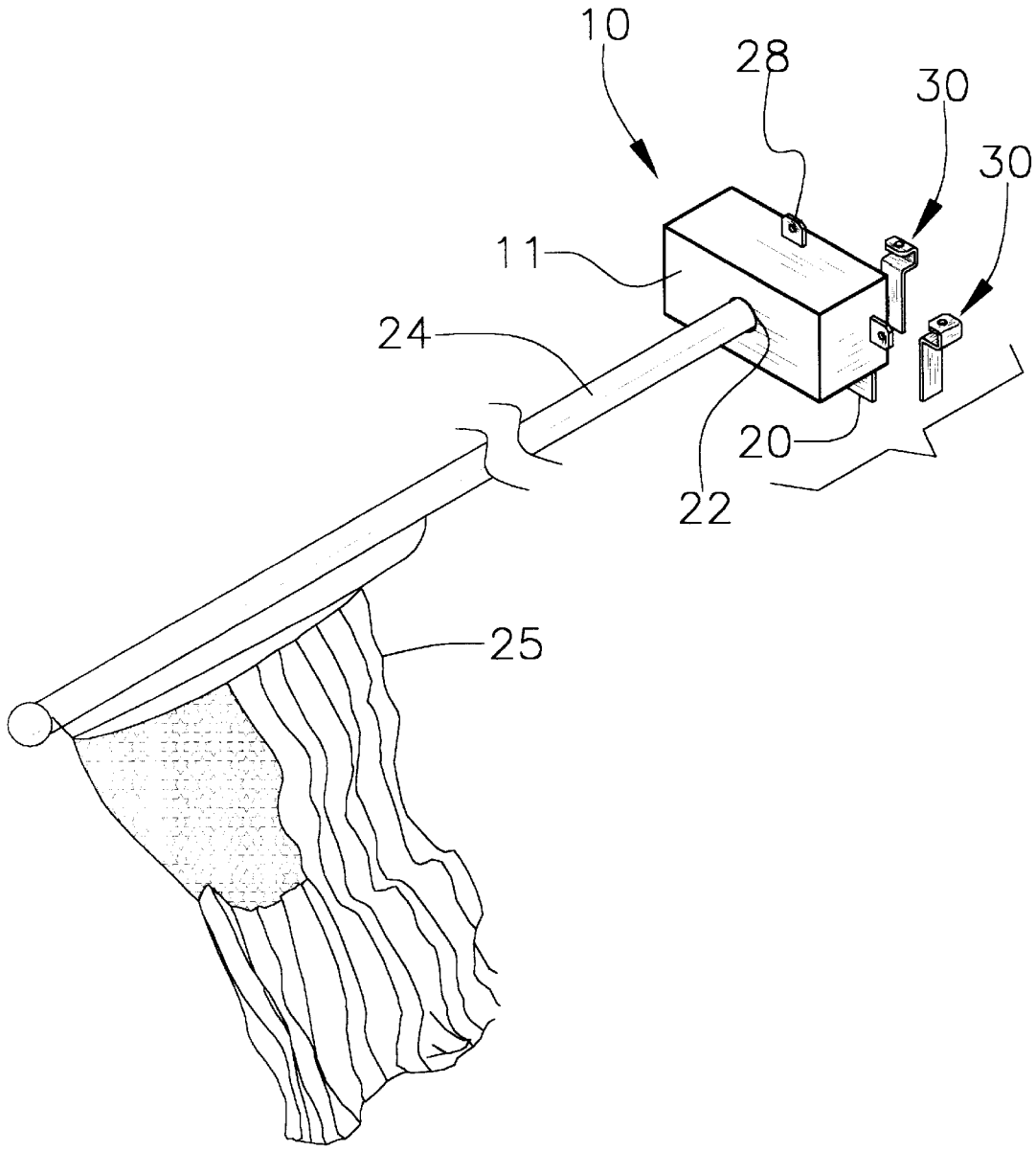
FIG. 4 is a schematic perspective view of the present invention in the lowered position.

As illustrated in FIGS. 2 and 4, when the mounting base is positioned in the lowered position, the first side face of the mounting base is rested on the resting surface and the bottom edge of the mounting base lie in a plane extending substantially perpendicular to the resting surface so that the open bottom face is exposed. The top face of the mounting base lies in a substantially vertical plane when the mounting base is positioned in the lowered position.

Figure 3:
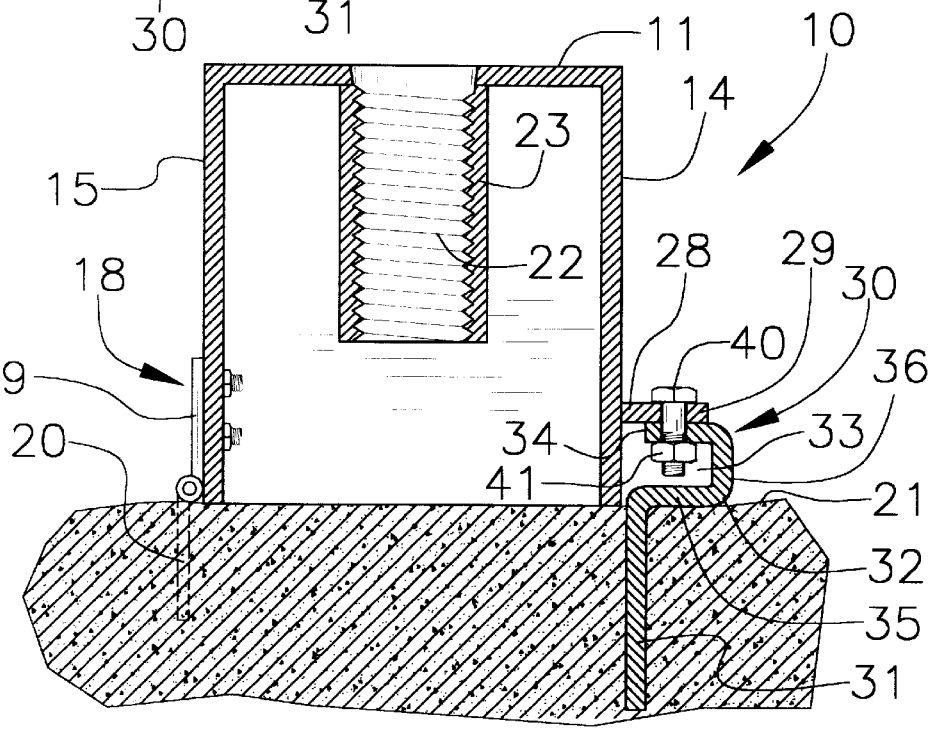
FIG. 3 is a schematic cross sectional view of the present invention in the raised position taken from line 3—3 of FIG. 1.

With particular reference to FIG. 3, the mounting base has a threaded bore 22 therein. The threaded bore has a generally circular opening in the top face of the mounting base and a longitudinal axis preferably extending substantially perpendicular to the top face of the mounting base. In the hollow preferred embodiment, the mounting base has an generally cylindrical tubular inner extent 23 extending inwardly into the mounting base from the top face of the mounting base. The inner extent of the mounting base has a threaded lumen defining the threaded bore of the mounting bore.

The mounting base is designed for use with an elongate flag pole 24 having opposite top and bottom ends and a longitudinal axis extending between the top and bottom ends of the pole. A flag 25 may be coupled to the pole adjacent to the top end of the pole. As illustrated in FIG. 1, the pole has a threaded portion 26 adjacent the bottom end of the pole which is threadably extended into the threaded bore of the mounting base. This way, the top end of the pole is outwardly extended away from the top face of the mounting base with the longitudinal axis of the pole is extended substantially perpendicular to the top face of the mounting base.

In a preferred embodiment, the inner extent has an open lower end 27 positioned spaced apart from the plane in which the bottom edge of the mounting base lies. In such an embodiment, the bottom end of the pole is extended through the lower open end of the inner extent to permit threading of a lower securing nut onto the threaded portion of the pole to prevent someone from removing the pole simply by rotating it out of the threaded bore. It is for this reason that the lower end of the inner extent is spaced apart from the bottom edge of the mounting base to provide clearance for the lower securing nut.

In use, the pole is extended substantially vertical when the mounting base is positioned in the raised position and substantially horizontal when the mounting base is positioned in the lowered position.

The end faces and a second of the side faces of the mounting base each have a tab 28 outwardly extending therefrom. The tabs are spaced apart from the bottom edge of the mounting base. The tabs each are ideally extended substantially parallel to the top face of the mounting base. Each of the tabs has a generally circular hole 29 therethrough.

The system also includes a plurality of spaced apart anchors 30. Each of the anchors is associated with one of the tabs. Each of the anchors has an elongate lower portion 31 and a generally rectangular U-shaped upper portion upper 32 defining a clearance space 33 therein. As best illustrated in FIG. 3, the lower portions of the anchors are inserted into the resting surface such that the lower portions of the anchors are embedded in the concrete material with the clearance channels of the anchors each facing towards the respective associated face of the mounting base when the mounting base is positioned in the raised position.

The upper portion of each anchor comprises spaced apart and substantially parallel upper and lower extents 34,35 and a side extent 36 connect the upper and lower extents of the respective upper portion together. The upper extents each have a generally circular hole 37 therethrough.

In use, the upper extent of each upper portion is positioned directly beneath the respective associated tab as illustrated in FIG. 3 when the mounting base is positioned in the raised position. In this raised position, the holes of each associated tab and upper extent pair are coaxially aligned with each other. Extended through the holes of one associated tab and upper extent pair is a bolt 38 of a padlock 39 when the mounting base is positioned in the raised position to lock the mounting base in the raised position. Threaded fasteners 40 are extended through the holes of each remaining associated tab and upper extent pair when the mounting base is positioned in the raised position. Each of the threaded fasteners has a nut 41 threaded thereon and positioned in the clearance channel of the associated anchor. This combination of lock and threaded fasteners secures the mounting base in the raised position and prevents unauthorized users from pivoting the mounting base to the lowered position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A flag pole mounting system, comprising:

a mounting base having a top face, an open bottom face, a spaced apart pair of end faces, and a spaced apart pair of side faces;

said mounting base adapted for pivotally mounting to a resting surface;

said mounting base having a threaded bore therein, said threaded bore having an opening in said top face of said mounting base, said threaded bore being adapted for receiving a bottom end of a flag pole therein; and a pair of hinges each having upper and lower leaves pivotally coupled to each other, said upper leaves of said hinges being coupled to a first of said side faces of said mounting base, said lower leaves of said hinges being adapted for insertion into the resting surface to pivotally mount said mounting base to the resting surface.

2. The flag pole mounting system of claim 1, wherein said mounting base has a tubular inner extent extending inwardly into said mounting base from said top face of said mounting base, said inner extent of said mounting base having a threaded lumen defining said threaded bore of said mounting base.

3. The flag pole mounting system of claim 2, wherein said inner extent has an open lower end positioned spaced apart from said open bottom face of said mounting base.

4. The flag pole mounting system of claim 1, wherein at least one of said end faces and side faces of said mounting base has a tab outwardly extending therefrom, said tab being spaced apart from said open bottom face of said mounting base.

5. The flag pole mounting system of claim 4, further comprising an anchor having an elongate lower portion and a generally rectangular U-shaped upper portion defining a clearance space therein, said clearance space facing towards said mounting base, said lower portion of said anchor being adapted for insertion into the resting surface.

6. The flag pole mounting system of claim 5, wherein said upper portion of said anchor has spaced apart upper and lower extents and a side extent connecting said upper and lower extents together, said upper extent having a hole therethrough, said tab having a hole therethrough and coaxially aligned with said hole of said upper extent, a locking bolt of a padlock being extended through said holes of said upper extent and said tab.

7. A flag pole mounting system, comprising:

a mounting base having a generally rectangular box-shaped configuration and comprising a generally rectangular substantially planar top face, an open bottom face, a spaced apart pair of generally rectangular substantially planar end faces, and a spaced apart pair of generally rectangular substantially parallel side faces extending substantially perpendicular to said end faces of said mounting base;

said mounting base having a generally rectangular bottom edge extending along said end and side faces to define said open bottom face of said mounting base;

said top face and said bottom edge of said mounting base lying in substantially parallel planes to one another;

a pair of hinges each having upper and lower leaves pivotally coupled to each other;

said upper leaves of said hinges being coupled to a first of said side faces of said mounting base;

said lower leaves of said hinges being outwardly extended from said bottom edge of said mounting base;

a resting surface, wherein said resting surface comprises a concrete material;

said lower leaves of said hinges being inserted into said resting surface;

said hinges permitting pivoting of said mounting base between raised and lowered positioned with respect to said resting surface;

said bottom edge of said mounting base being rested on said resting surface such that said open bottom face faces said resting surface when said mounting base is positioned in said raised position, said top face of said mounting base facing upwards from said resting surface and lying in a substantially horizontal plane when said mounting base is positioned in said raised position;

said first side face of said mounting base being rested on said resting surface and said bottom edge of said mounting base lying in a plane extending substantially perpendicular to said resting surface such that said open bottom face is exposed when said mounting base is positioned in said lowered position, said top face of said mounting base lying in a substantially vertical plane when said mounting base is positioned in said lowered position;

said mounting base having a threaded mounting bore therein, said mounting bore having a generally circular opening in said top face of said mounting base, said threaded bore having a longitudinal axis extending substantially perpendicular to said top face of said mounting base;

wherein said mounting base has an generally cylindrical tubular inner extent extending inwardly into said mounting base from said top face of said mounting base, said inner extent of said mounting base having a threaded lumen defining said threaded bore of said mounting base;

said inner extent having an open lower end positioned spaced apart from the plane in which said bottom edge of said mounting base lies;

an elongate pole having opposite top and bottom ends and a longitudinal axis extending between said top and bottom ends of said pole;

said pole having a threaded portion adjacent said bottom end of said pole threadably extended into said threaded bore of said mounting base;

said top end of said pole being outwardly extended away from said top face of said mounting base, said longitudinal axis of said pole being extended substantially perpendicular to said top face of said mounting base;

said end faces and a second of said side faces of said mounting base each having a tab outwardly extending therefrom, said tabs being spaced apart from said bottom edge of said mounting base;

said tabs each being extended substantially parallel to said top face of said mounting base;

each of said tabs having a generally circular hole therethrough;

a plurality of spaced apart anchors, each of said anchors being associated with one of said tabs;

each of said anchors having an elongate lower portion and a generally rectangular U-shaped upper portion defining a clearance space therein;

said lower portions of said anchors being inserted into said resting surface, said clearance channels of said anchors each facing towards the respective associated face of said mounting base when said mounting base is positioned in said raised position;

said upper portion of each anchor having spaced apart and substantially parallel upper and lower extents and a side extent connect said upper and lower extents of the respective upper portion together;

said upper extents each having a generally circular hole therethrough said upper extent of each upper portion being positioned beneath the respective associated tab;

said holes of each associated tab and upper extent pair being coaxially aligned with each other when said mounting base is positioned in said raised position;

a bolt of a padlock being extended through said holes of one associated tab and upper extent pair when said mounting base is positioned in said raised position to lock said mounting base in said raised position; and a threaded fastener being extended through the holes of each remaining associated tab and upper extent pair when said mounting base is positioned in said raised position, each of said threaded fasteners having a nut threaded thereon and positioned in said clearance channel of the associated anchor.

8. A flag pole mounting system, comprising:

a mounting base having a top face, an open bottom face, a spaced apart pair of end faces, and a spaced apart pair of side faces;

said mounting base adapted for pivotally mounting to a resting surface;

said mounting base having a threaded bore therein, said threaded bore having an opening in said top face of said mounting base, said threaded bore being adapted for receiving a bottom end of a flag pole therein;

wherein at least one of said end faces and said pair of side walls of said mounting base has a tab outwardly extending therefrom, said tab being spaced apart from said open bottom face of said mounting base; and an anchor having an elongate lower portion and a U-shaped upper portion defining a clearance space therein, said clearance space facing towards said mounting base, said lower portion of said anchor being adapted for insertion into the resting surface.

9. The flag pole mounting system of claim wherein said mounting base has a tubular inner extent extending inwardly into said mounting base from said top face of said mounting base, said inner extent of said mounting base having a threaded lumen defining said threaded bore of said mounting base.

10. The flag pole mounting system of claim 9, wherein said inner extent has an open lower end positioned spaced apart from said open bottom face of said mounting base.

11. The flag pole mounting system of claim 8, wherein said upper portion of said anchor has spaced apart upper and lower extents and a side extent connecting said upper and lower extents together, said upper extent having a hole therethrough, said tab having a hole therethrough and coaxially aligned with said hole of said upper extent, a locking bolt of a padlock being extended through said holes of said upper extent and said tab.

* * * * *